US008193717B2

(12) United States Patent
Leiderman

(10) Patent No.: US 8,193,717 B2
(45) Date of Patent: Jun. 5, 2012

(54) CONTROLLER AND METHOD FOR CONTROLLING AN INTENSITY OF A LIGHT EMITTING DIODE (LED) USING A CONVENTIONAL AC DIMMER

(75) Inventor: Slava Leiderman, Rishon Lezion (IL)

(73) Assignee: Lightech Electronic Industries Ltd., Northern Industrial Zone (IL)

( * ) Notice: Subject to any disclaimer, the term of this patent is extended or adjusted under 35 U.S.C. 154(b) by 429 days.

(21) Appl. No.: 12/342,471

(22) Filed: Dec. 23, 2008

(65) Prior Publication Data

US 2009/0160358 A1 Jun. 25, 2009

(30) Foreign Application Priority Data

Dec. 24, 2007 (IL) ..... 188348

(51) Int. Cl.
*H05B 37/02* (2006.01)

(52) U.S. Cl. ..... 315/219; 315/299; 315/308; 323/300

(58) Field of Classification Search ..... 315/209 R, 315/219, 291, 299, 307, 308; 323/217, 299, 323/300

See application file for complete search history.

(56) References Cited

U.S. PATENT DOCUMENTS

| | | | | |
|---|---|---|---|---|
| 4,745,351 | A * | 5/1988 | Rowen et al. | 323/239 |
| 5,585,713 | A * | 12/1996 | Crane et al. | 323/323 |
| 5,798,581 | A * | 8/1998 | Keagy et al. | 307/115 |
| 6,069,457 | A * | 5/2000 | Bogdan | 315/291 |
| 6,304,464 | B1 | 10/2001 | Jacobs et al. | |
| 6,369,525 | B1 | 4/2002 | Chang et al. | |
| 7,902,769 | B2 * | 3/2011 | Shteynberg et al. | 315/291 |
| 2006/0071614 | A1 | 4/2006 | Tripathi et al. | |
| 2006/0279228 | A1 | 12/2006 | Kato | |
| 2009/0160627 | A1 * | 6/2009 | Godbole | 340/310.11 |

FOREIGN PATENT DOCUMENTS

| | | | |
|---|---|---|---|
| EP | 1 608 206 | A1 | 12/2005 |
| JP | A-2006-196510 | | 7/2006 |
| WO | WO 03/058801 | A1 | 7/2003 |
| WO | WO 03/096761 | A1 | 11/2003 |
| WO | WO 2005/087110 | A1 | 9/2005 |
| WO | WO 2006/018830 | A2 | 2/2006 |

OTHER PUBLICATIONS

"TNY264/266-268 TinySwitch-II Family—Enhanced, Energy Efficient, Low Power Off-line Switcher," Jul. 2001, Product datasheet from Power Integration, Inc.

"HV9931 Unity Power Factor LED Lamp Driver, Initial Release," Jan. 2005, pp. 1-8, Supertext, Inc.

* cited by examiner

*Primary Examiner* — Thuy Vinh Tran

(74) *Attorney, Agent, or Firm* — Oliff & Berridge, PLC

(57) ABSTRACT

A flicker-free method and a control circuit is used in conjunction with a conventional AC dimmer coupled to a main-AC supply to continuously control an intensity of a Light Emitting Diode (LED) over substantially a full range of the dimmer. The control circuit has a controllable source of DC voltage that is configured for coupling to at least one LED and that is powered independently of an output of the AC dimmer thereby isolating the LED voltage from the output of the AC dimmer; and a controller coupled to the source of DC voltage. The controller is powered independently of the output of the AC dimmer and is responsive to a firing angle of the AC dimmer for varying a level of the DC voltage as a function of said firing angle.

14 Claims, 3 Drawing Sheets

CONTROLLER AND METHOD FOR CONTROLLING AN INTENSITY OF A LIGHT EMITTING DIODE (LED) USING A CONVENTIONAL AC DIMMER

CROSS REFERENCE TO RELATED APPLICATIONS

This application claims the benefit of Israeli Patent Application Number 188348 filed on Dec. 24, 2007 which is hereby incorporated by reference herein.

FIELD OF THE INVENTION

This invention relates to dimmers for use with Light Emitting Diodes (LEDs).

BACKGROUND OF THE INVENTION

Lamp dimmers for coupling to the AC mains supply voltage typically employ angle modulation of a switching device such as a triac so as to adjust the duty cycle of the AC dimmer output signal. In so-called "leading edge" dimmers, the triac is selectively operated to adjust the duty cycle (i.e. modulate the phase angle) of the dimmer output signal by removing rising portions of AC voltage half-cycles (i.e. after zero-crossings and before peaks). In so-called "trailing edge" a triac can be controlled to remove falling portions of AC voltage half-cycles (i.e. after peaks and before zero-crossings).

With the growing popularity of LEDs for domestic and other lighting, the need to adjust the brightness of LEDs is increasing. Since AC lamp dimmers are commonly available, it would clearly be desirable to allow them to be used also for LEDs. However, there are several technical reasons which militate against this. One problem is that LEDs are powered using DC typical converters and are not ideally suited to operation from an AC supply particularly when operated at reduced output. Specifically, when power is reduced such that there is insufficient load on the triac, this gives rise to flicker. This is unpleasant when dimmers are used with low power halogen lamps that may have a power rating of 20 W, but it can be quite intolerable when used with LEDs having a power rating of only 1 W.

Typically converters used for AC-operated lamps, such as halogen lamps, are based on the conversion of low frequency mains voltage AC to high frequency, low voltage AC. The voltage that is applied to the lamp is the low frequency envelope that contains high frequency harmonics, which are undesirable when using LEDs.

Also with conventional converters used with halogen lamps, when there is no dimming there is almost unity power factor. But when dimming is used, the power factor may fall to as low 0.3. As opposed to this, converters for use with LEDs are based on a different topology, which employ power factor correction so as ensure that the power factor does not fall below 0.8 when dimming occurs.

U.S. Pat. No. 6,304,464 discloses a circuit arrangement for operating a LED array with an installed power in the range from 6 W as a minimum to at least 15 W. A flyback converter is used to achieve good power factor as well as a low level of harmonic distortion (THD) of mains current extracted from the supply source.

Further since the mains voltage is subject to fluctuations typically in the order of ±10%, the output of the converter is likewise subject to the same fluctuations. This also is unsuitable for use with LEDs, which require a stabilized voltage source.

Power supplies for use with AC dimmers are typically designed to operate from a single voltage power supply only, such as either 110 VAC or 220 VAC. However, converters for use with LEDs are typically suitable for use with so-called universal input power supplies that are intended to operate over a range of power supply voltages, such as 85-277 VAC so as to be suitable for both the US and European markets. Therefore, in order to utilize a dimmer with LEDs while maintaining conventional drive circuitry, the dimmer should preferably be adapted to operate with a range of supply voltages. This may also militate against the use of conventional AC dimmers.

WO 03/096761 assigned to Color Kinetics, Inc. discloses methods and apparatus for facilitating the use of LED-based light sources on AC power circuits that provide signals other than standard line voltages thus allowing LED-based light sources to be coupled to AC power circuits that are controlled by conventional AC dimmers, Optionally, a microprocessor-based controller may be used to provide to appropriately condition an AC signal provided by a dimmer circuit so as to provide power to one or more LEDs of the lighting unit. Thus, the microprocessor may be configured to digitally sample the dimmer output voltage and process the samples according to some predetermined criteria to determine if one or more functions need to be performed. By such means, an AC dimmer circuit may be used to adjust one or more parameters of generated light via user operation of the dimmer. The parameters of light that may be adjusted include intensity, brightness or color (e.g. hue, saturation or brightness) that may be controlled in response to dimmer operation. For example, the sampled dimmer voltage may be mapped to stored values of various control signals used to control the LED-based light source, such as duty cycles of PWM signals respectively applied to differently colored LEDs of the light source. The microprocessor may also be configured to "evaluate" the dimmer output voltage and perform one or more functions in response thereto. By such means, the microprocessor-based controller is able to sample the AC dimmer output voltage or a control signal characteristic of the degree of angle modulation ("firing angle") and to use the resulting signal to adjust brightness of the LEDs.

However, in all embodiments thereof, the control circuitry itself is powered by the AC dimmer output voltage. As a result, when the dimmer is set too low, there is the risk that there will be insufficient voltage to power the controller. This creates a dead space of the dimmer, where the controller is shut down and the LEDs are consequently extinguished. This deficiency is acknowledged, for example, on page 19, lines 24-27, where it is stated that if the dimmer is adjusted such that the AC signal is no longer capable of providing adequate power to the drive circuitry, the light source merely ceases to produce light.

Likewise, with regard to those embodiments that use a controller to process the dimmer output, it is noted on page 26, lines 5-8 that as the overall power provided by the AC signal is reduced due to operation of a dimmer, at some point the power circuitry will be unable to provide sufficient power to the various components of the lighting unit and it will cease to generate light.

WO 03/096761 states that it provides sufficient power to the lighting unit "over a significant range of dimmer operation." It is instructive to determine the range of dimmer operation over which the lighting unit described by WO 03/096761 remains illuminated. As shown in FIG. 6, the AC dimmer voltage is fed to a TNY266 IC switch manufactured by Power Integrations, Inc. of San Jose, Calif. USA that operates as a DC converter to produce a constant DC output voltage from a range of input AC voltages, Reference to the TNY266 Data Sheet shows that it operates over a universal voltage supply (85-265 VAC). This implies that if the AC dimmer RMS output voltage falls below 85 VAC, the TNY266 will no longer operate.

Moreover, once the dimmer voltage is increased beyond this "dead space", the power circuitry suddenly kicks in with a correspondingly higher control voltage. Thus, in the case where the control voltage is derived from the dimmer modulation (or firing) angle and assuming that effective control by the dimmer requires adjustment of the firing angle between 0 and 90° in both AC half-cycles, the DC converter kicks in only when the minimum firing angle is reached. And if the lamp intensity is a linear function of the firing angle, this means that not only is the dimmer inactive over much of its range, but also that when it does become active the lamp will hardly be particularly dim.

This limitation is not important to WO 03/096761 since its main object is not to control the intensity of the lights but rather their color, which is varied by combining different colors of more than one light source. To this end, each light source may be independently varied in response to a common control signal. This may be done by using tables to map different PWM duty cycles for each light source and to employ a different table for each lamp. By such means, millions of colors may be generated, which may also be combined to form white light.

Thus, WO 03/096761 appears to offer a circuit for varying the colors of LED arrays over a limited range of an AC dimmer. It does not provide a circuit for varying the intensity of an LED over substantially the full range of an AC dimmer.

It is apparent that the limitations of WO 03/096761 derive from operating the power control circuitry directly from the AC dimmer output. However, there is an advantage in doing so because it ensures that at all times the AC dimmer is loaded. In normal conditions, the lamp itself loads the dimmer and this reduces lamp flicker that would otherwise ensue were the dimmer to be unloaded during part of the AC supply cycle. So it would be desirable to provide a flicker-free method and circuit for varying the intensity of an LED over substantially the full range of an AC dimmer.

WO 03/058801 in the name of the present applicant discloses a lamp transformer for use with an electronic dimmer and method for use thereof for reducing acoustic noise.

WO 06/018830 in the name of the present applicant discloses use of a controller to reconstruct suitably amended waveforms for leading and trailing edge dimmers.

The full contents of each of the above-references are incorporated herein by reference.

SUMMARY OF THE INVENTION

The invention provides a flicker-free method and circuit for varying the intensity of an LED over substantially the full range of an AC dimmer.

In accordance with one aspect the invention provides a method for using a conventional AC dimmer coupled to a mains AC supply to continuously control an intensity of a Light Emitting Diode (LED) over substantially a full range of the dimmer, the method comprising:

providing a controllable source of DC voltage that is configured for coupling to at least one LED and that is powered independently of an output of the AC dimmer thereby isolating the LED voltage from the output of the AC dimmer; and coupling to the source of DC voltage a controller that is powered independently of the output of the AC dimmer and that is responsive to a firing angle of the AC dimmer for varying a level of the DC voltage as a function of said firing angle.

In accordance with another aspect of the invention there is provided a control circuit for use in conjunction with a conventional AC dimmer coupled to a mains AC supply to continuously control an intensity of a Light Emitting Diode (LED) over substantially a full range of the dimmer, the control circuit comprising:

a controllable source of DC voltage that is configured for coupling to at least one LED and that is powered independently of an output of the AC dimmer thereby isolating the LED voltage from the output of the AC dimmer; and a controller coupled to the source of DC voltage, the controller being powered independently of the output of the AC dimmer and being responsive to a firing angle of the AC dimmer for varying a level of the DC voltage as a function of said firing angle.

BRIEF DESCRIPTION OF THE DRAWINGS

In order to understand the invention and to see how it may be carried out in practice, an embodiment will now be described, by way of non-limiting example only, with reference to the accompanying drawings, in which.

DETAILED DESCRIPTION OF EMBODIMENTS

Figure 1:
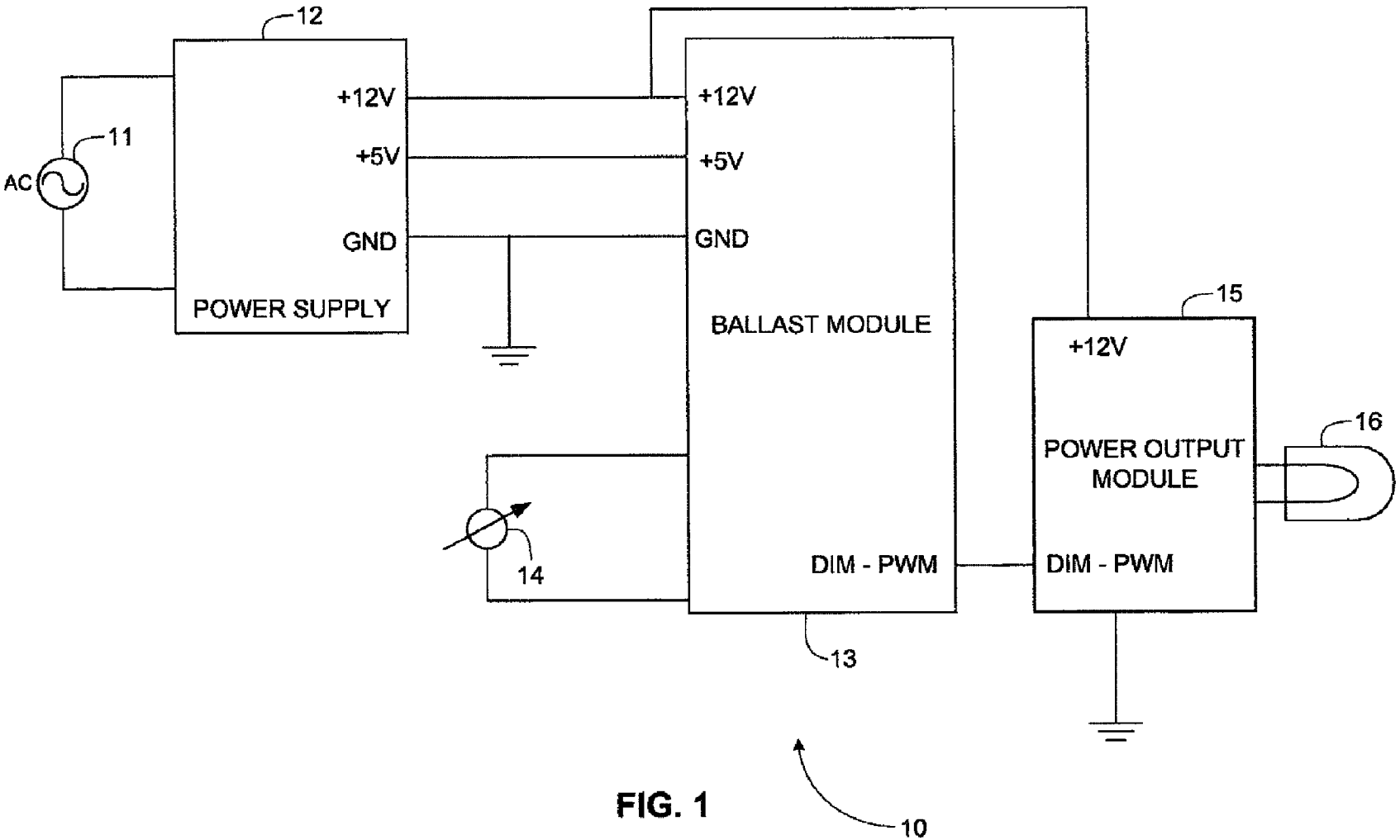
FIG. 1 is a block circuit diagram showing functionally a LED dimmer circuit according to an embodiment of the invention.

FIG. 1 is a block circuit diagram showing functionally a LED dimmer circuit 10 according to an embodiment of the invention. An AC main supply 11 is fed to a power supply 12 that has +5 and +12 volt outputs fed to corresponding inputs of a ballast module 13. The ballast module 13 constitutes a control circuit that has control inputs coupled to a conventional AC lamp dimmer 14 and includes a pulse width modulation circuit having an output shown as DIM-PWM that varies according to the firing angle of the dimmer 14. The output DIM-PWM of the ballast module 13 is coupled to a power output module 15 that is powered by the +12 V output of the power supply 12 and that has an output to which one or more LEDs 16 are coupled.

It will thus be noted that in the circuit shown in FIG. 1, the AC dimmer 14 serves only to feed a signal indicative of its firing angle to the ballast module 13. The power supply 12 is fed directly from the AC mains supply 11, which may be a universal power supply operating having an output of 85-220 VAC. The power supply 12 may be any suitable DC power supply and is not described in further detail. However, for the sake of enablement it could be based on the TNY266 IC switch to whose data sheet reference has already been made.

Figure 2:
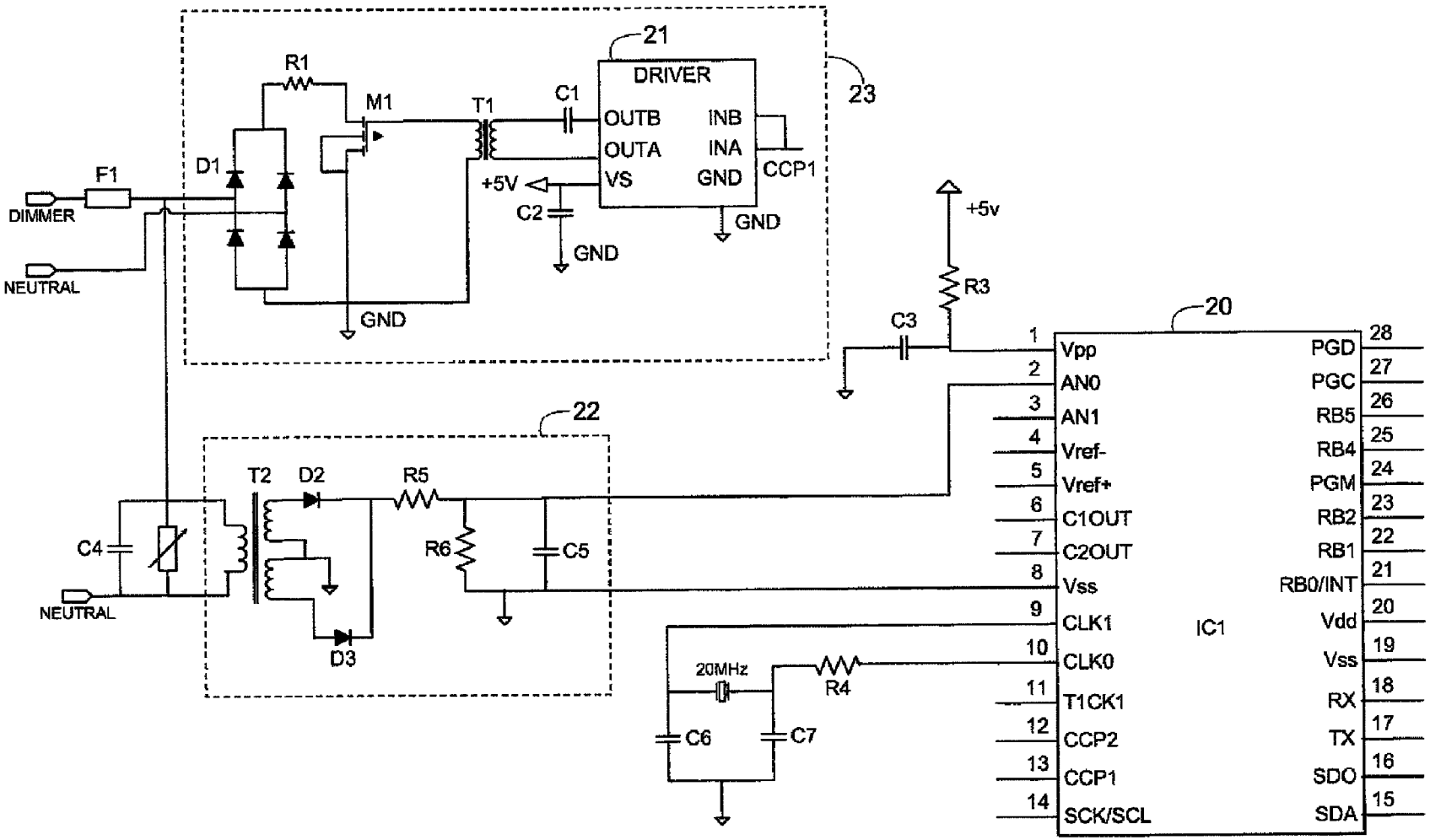
FIG. 2 is a schematic circuit diagram showing principal components in an embodiment of the LED dimmer circuit shown in FIG. 1.

FIG. 2 is a schematic circuit diagram showing principal components in the LED dimmer circuit 10. In order not to obscure the invention, only the principal components are shown in the figure. In one embodiment reduced to practice, the heart of the ballast module 13 is a PIC 16F876A microprocessor 20 manufactured by Microchip Technology Inc. whose datasheet is incorporated herein by reference. A 20

MHz crystal oscillator in combination with capacitors C6 and C7 and resistor R4 serve to provide the required clock signal to the microprocessor 20. Pin 13 designated CCP1 is a PWM output that feeds pulses via a driver 21 to a pulse transformer T1 to the gate of a MOSFET switch M1. This feeds a drive signal at a frequency determined by the PWM output the MOSFET M1, causing the MOSFET to close, thereby momentarily loading the dimmer 14 via the resistor R1 and the bridge rectifier D1 and simulating the "ON" state, the current fed to the dimmer 14 being determined by resistor R1. During this short time interval the voltage across the dimmer 14 is half-wave rectified by the transformer T2 in combination with rectifier diodes 92 and 93 and filtered by a filter comprising the capacitor C5 in parallel with the resistor R6. The resulting DC voltage whose level is indicative of the dimmer output voltage is fed to the A0 input (Pin 2) of the microprocessor 20, which is the input of A/D converter. The transformer T2 in combination with rectifier diodes 92, D3, capacitor C5 and resistors R5 and R6 thus constitute a voltage sensor shown as 22 in FIG. 2 for producing a signal representative of an output voltage of the dimmer. Likewise, the microprocessor 20 operates as a detector for producing a control signal when the output voltage of the dimmer changes.

Figure 3:
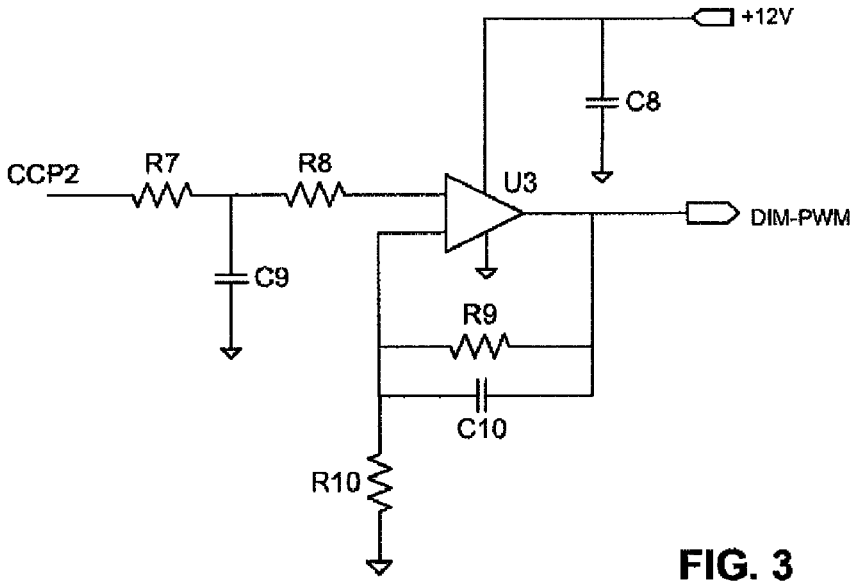
FIG. 3 a schematic circuit diagram showing a detail of the LED dimmer circuit shown in FIG. 1.

In this mode of operation, the voltage fed to A/D input serves to set the PWM output on pin 12 (CCP2) as shown in more detail in FIG. 3. Thus, the CCP2 signal is fed to an OP AMP (U3) that operates as an integrator and the output of which is the PWM signal, DIM-PWM that is fed to the power output module 15.

Figure 4:
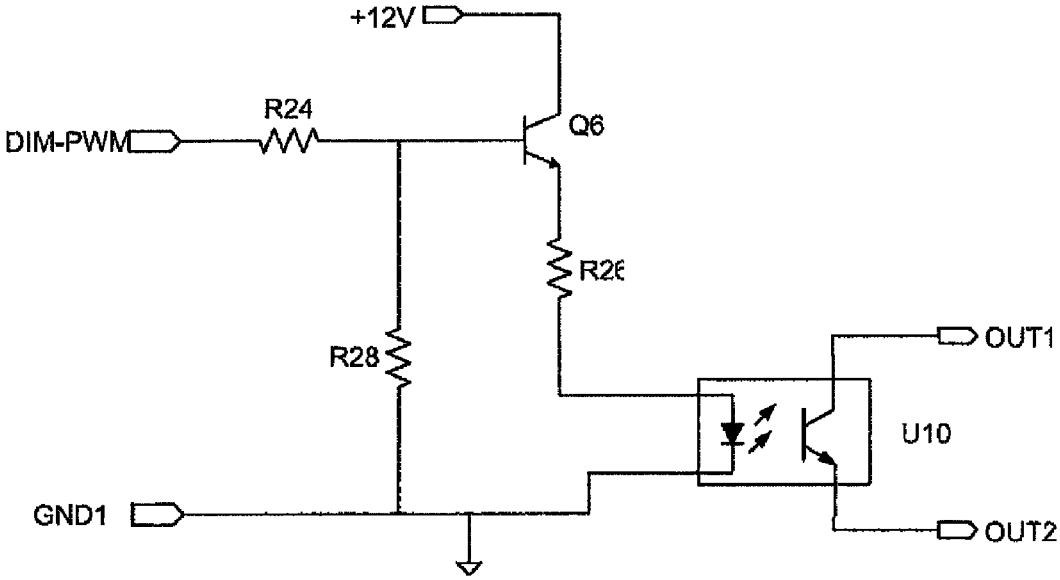
FIG. 4 a schematic circuit diagram showing a detail of the power output module shown in FIG. 1.

FIG. 4 is a schematic circuit diagram showing a detail of the power output module 15 shown in FIG. 1. The +12 V DC supply is fed to the collector of a bipolar junction transistor Q6 whose base is switched by the DIM-PWM signal output by the ballast module 13 and shown at the output of the OP-AMP U3 in FIG. 3. The emitter of the transistor Q6 is fed to an opto-coupler U10 whose output is fed to the LED 16. Multiple LEDs can be powered by the same dimmer 14 by coupling a respective power output module 15 for each LED to the ballast module 13.

Having described the circuit topology its operation will now be described. The driver 21 loads the dimmer 14 via the pulse transformer T1 at a known sampling frequency, typically in the order of 30 kHz determined by the micro-controller 20. Thus the driver 21 in combination with the pulse transformer T1, the MOSFET M1 and the resistor R1 and the bridge rectifier D1 constitute a loading circuit shown as 23 in FIG. 2. At the same time the rectified dimmer output is sampled via the transformer T2 and associated circuitry. Thus, at the instant of sampling the dimmer output, the dimmer is loaded. This ensures that there is no flicker, which would otherwise occur were the dimmer angle to be sampled without loading the dimmer. For a leading edge dimmer, before the dimmer is fired, the dimmer voltage is zero but this rises to the instantaneous magnitude of the AC voltage supply when the dimmer is fired. So the dimmer output voltage sampled by the micro-controller 20 changes from zero to a non-zero value on firing, and the number of sampling pulses then gives an indication of the dimmer firing angle. For a trailing edge voltage, the sampled dimmer output voltage is equal to the instantaneous magnitude of the AC voltage supply until the dimmer is fired, when it then falls to zero. So in this case, the change in sampled dimmer output voltage from a non-zero value to zero is indicative of the dimmer firing and the number of sampling pulses is representative of the firing angle.

Once the firing angle is thus determined, the ballast operates the same regardless of whether the dimmer is of the leading edge or trailing edge type since the firing angle is then translated to a PWM control signal as explained above.

Although in the above embodiments, the dimmer is intermittently loaded in sync with the samples pulses, it can be continually loaded e.g. with a resistive load.

It will also be appreciated that component types and values relating to FIGS. 2 and 3 are given by way of example only and in order to provide a fully enabling description. It will readily be appreciated that different ICs and clock frequencies may be employed without departing from the inventive concept as defined in the annexed claims.

The invention claimed is:

1. A flicker-free method for using a conventional AC dimmer coupled to a main AC supply to continuously control an intensity of a Light Emitting Diode (LED) over substantially a full range of the dimmer, the method comprising:

providing a controllable source of DC voltage that is configured for coupling to at least one LED and that is powered independently of an output of the AC dimmer thereby isolating the LED voltage from the output of the AC dimmer; and coupling to the source of DC voltage a controller that is powered independently of the output of the AC dimmer and that is responsive to a firing angle of the AC dimmer for varying a level of the DC voltage as a function of said firing angle.

2. The method according to claim 1, wherein the firing angle of the dimmer includes is determined by:

successively sampling the dimmer voltage at high sampling frequency while loading the dimmer until a change in dimmer voltage is detected; and computing the firing angle based on the number of samples and the sampling frequency.

3. The method according to claim 2, wherein loading the dimmer includes continually loading the dimmer.

4. The method according to claim 2, wherein loading the dimmer includes periodically loading the dimmer in synchronism with the sampling frequency.

5. The method according to claim 2, wherein the sampling frequency exceeds 10 KHz.

6. The method according to claim 2, wherein the dimmer is a leading edge dimmer and said change in dimmer voltage is detected when the dimmer voltage rises from zero.

7. The method according to claim 2, wherein the dimmer is a trailing edge dimmer and said change in dimmer voltage is detected when the dimmer voltage falls to zero.

8. A control circuit for use in conjunction with a conventional AC dimmer coupled to a main AC supply to continuously control an intensity of a Light Emitting Diode (LED) over substantially a full range of the dimmer, the control circuit comprising:

a controllable source of DC voltage that is configured for coupling to at least one LED and that is powered independently of an output of the AC dimmer thereby isolating the LED voltage from the output of the AC dimmer; and a controller coupled to the source of DC voltage, the controller being powered independently of the output of the AC dimmer and being responsive to a firing angle of the AC dimmer for varying a level of the DC voltage as a function of said firing angle.

9. The control circuit according to claim 8, wherein the controller includes:

a voltage sensor for producing a signal representative of an output voltage of the dimmer;

a detector coupled to the voltage sensor for producing a control signal when the output voltage of the dimmer changes;

a loading circuit for loading the dimmer;

a sampling circuit coupled to the comparator for successively sampling the dimmer voltage at high sampling frequency while the dimmer is loaded until a change in dimmer voltage is detected; and a computation circuit for computing the firing angle based on the number of samples and the sampling frequency.

10. The control circuit according to claim 9, wherein the loading circuit is adapted to load the dimmer continually.

11. The control circuit according to claim 9, wherein the loading circuit is adapted to load the dimmer periodically in synchronism with the sampling frequency.

12. The control circuit according to claim 9, wherein the sampling frequency exceeds 10 KHz.

13. The control circuit according to claim 9, wherein the dimmer is a leading edge dimmer and the detector is adapted to detect said change in dimmer voltage when the dimmer voltage rises from zero.

14. The control circuit according to claim 9, wherein the dimmer is a trailing edge dimmer and the detector is adapted to detect said change in dimmer voltage when the dimmer voltage falls to zero.

* * * * *